US007224927B2

(12) United States Patent
Sano et al.

(10) Patent No.: US 7,224,927 B2
(45) Date of Patent: May 29, 2007

(54) DEVELOPING ROLLER FOR USE IN IMAGE-FORMING APPARATUS AND DEVELOPING APPARATUS EQUIPPED WITH THE SAME

(75) Inventors: Tetsuo Sano, Toyokawa (JP); Yohei Nakade, Okazaki (JP); Ichiro Demizu, Toyonaka (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 177 days.

(21) Appl. No.: 10/967,266

(22) Filed: Oct. 19, 2004

(65) Prior Publication Data

US 2006/0018686 A1 Jan. 26, 2006

(30) Foreign Application Priority Data

Jul. 20, 2004 (JP) ..... 2004-211521

(51) Int. Cl.
*G03G 15/08* (2006.01)

(52) U.S. Cl. ..... 399/286; 399/279

(58) Field of Classification Search ..... 399/286, 399/279, 265, 267, 159, 176, 313, 333, 357; 492/18, 25, 53, 56, 52, 49
See application file for complete search history.

(56) References Cited

U.S. PATENT DOCUMENTS

| | | | | |
|---|---|---|---|---|
| 4,958,193 | A * | 9/1990 | Nojima et al. | 399/286 |
| 5,099,285 | A * | 3/1992 | Hirano et al. | 399/286 |
| 5,136,335 | A * | 8/1992 | Takeda et al. | 399/286 |
| 5,320,598 | A * | 6/1994 | Haak et al. | 604/20 |
| 5,716,700 | A * | 2/1998 | Kikukawa et al. | 399/279 X |
| 6,397,032 | B1 | 5/2002 | Sakaizawa et al. | |
| 6,681,093 | B2 | 1/2004 | Inoue et al. | |
| 2003/0190470 | A1 * | 10/2003 | Ream et al. | 428/379 |

FOREIGN PATENT DOCUMENTS

| | | | |
|---|---|---|---|
| JP | 11-190940 | | 7/1999 |
| JP | 2004-138810 | A * | 5/2004 |

* cited by examiner

*Primary Examiner*—Sophia S. Chen
(74) *Attorney, Agent, or Firm*—Buchanan Ingersoll & Rooney PC

(57) ABSTRACT

A developing roller for use in an image-forming apparatus, the roller including:
a substrate;
an elastic layer formed on the substrate;
a primer layer formed on the elastic layer; and
a surface-coating layer formed at the outermost surface, wherein the primer layer includes a conductive substance. A developing device is equipped with the developing roller.

6 Claims, 1 Drawing Sheet

DEVELOPING ROLLER FOR USE IN IMAGE-FORMING APPARATUS AND DEVELOPING APPARATUS EQUIPPED WITH THE SAME

This application is based on application No. 2004-211521 filed in Japan, the contents of which are hereby incorporated by reference.

BACKGROUND OF THE INVENTION

1. Field of the Invention

The present invention relates to a developing roller that is incorporated into a developing device for use in an image-forming apparatus so as to transport and supply toner to an opposing area to a photosensitive member (a developing area), and more particularly, concerns a mono-component-developing-use developing roller.

2. Description of the Related Art

The mono-component-developing-use developing roller, which is a developing roller to be incorporated into a developing device of a mono-component developing system, charges toner in a gap between it and a toner-regulating blade, and transports and supplies the charged toner to a developing area while supporting the charged toner.

Conventionally, with respect to the mono-component-developing-use developing roller, those having an elastic layer and a surface-coating layer formed on a substrate have been well known, from the viewpoint of charge-applying capability to toner and durability. From the viewpoint of preventing separation of the surface-coating layer, it has been known that a primer layer is effectively formed between the elastic layer and the surface-coating layer. With respect to a primer material to form the primer layer, for example, a silane coupling agent is used (see Japanese Patent Application Laid-Open No. 11-190940 (0060$^{th}$ paragraph).

However, when the above-mentioned developing roller is used under a low temperature-low humidity environment, a problem of toner spillage occurs from the initial stage. The term "toner spillage" refers to a phenomenon in which toner supported on the surface of a developing roller and supplied to a developing area is spilled from the surface to contaminate the inside of an image-forming apparatus. Another problem is that when such a developing roller is used for a long time, fluctuations tend to occur in the amount of toner transport to the developing area between the developing roller and the photosensitive member due to an environmental change.

SUMMARY OF THE INVENTION

The present invention is to provide a developing roller that prevents toner spillage and fluctuations in the amount of toner transport, even when it is used for a long time under any environment.

The present invention relates to a developing roller for use in an image-forming apparatus, comprising:

a substrate;

an elastic layer formed on the substrate;

a primer layer formed on the elastic layer; and a surface-coating layer formed at the outermost surface, wherein the primer layer comprises a conductive substance, and a developing device equipped with the developing roller.

DETAILED DESCRIPTION OF THE INVENTION

The present invention provides a developing roller for use in an image-forming apparatus, comprising:

a substrate;

an elastic layer formed on the substrate;

a primer layer formed on the elastic layer; and a surface-coating layer formed at the outermost surface, wherein the primer layer comprises a conductive substance, and a developing device equipped with the developing roller.

Even when used under any environment for a long time, the developing roller of the present invention makes it possible to stabilize the amount of toner transport to the developing area between the developing roller and the photosensitive member. Consequently, it becomes possible to effectively prevent toner spillage even when it is used under any environment, in particular, even under a low temperature-low humidity environment.

This preventive effect for toner spillage, obtained by stabilizing the amount of toner transport, is more efficiently exerted when an ion conductive substance, such as, in particular, a salicylic acid metal complex (in particular, aluminum salicylate complex), is used as the conductive substance.

Figure 1:
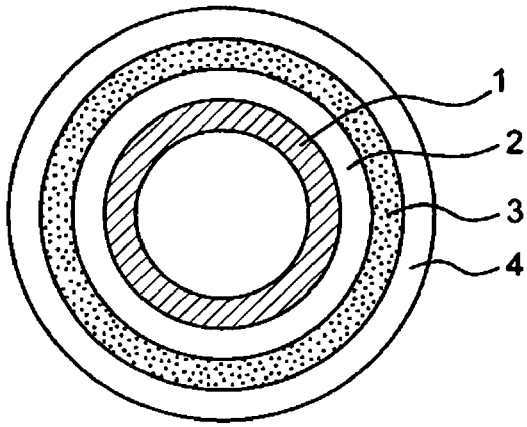
FIG. 1 is a schematic cross-sectional view perpendicular to the axis direction of a developing roller of the present invention.

For example, as shown in FIG. 1, the developing roller of the present invention is provided with at least an elastic layer 2, a primer layer 3 and a surface-coating layer 4 that are successively formed on a substrate 1, and in this structure, after the respective layers are successively formed on the substrate, these layers are heated to form the developing roller.

With respect to the substrate 1, not particularly limited as long as it is a conductor member capable of supporting the layers formed thereon, for example, a cylinder-shaped core member made of metal such as iron, aluminum and stainless is generally used. This may be subjected to a plating process.

The elastic layer 2 may be formed from any material as long as it exerts conductivity in such a level as to charge toner supported on the developing roller surface and elasticity in such a level as to control the toner so as to have a uniform thickness, when used in a system with a regulating blade. Preferably, this layer is allowed to have a volume resistivity in a range from $10^3$ to $10^6$ Ω·cm and JIS-A hardness in a range from 30° to 60°.

Specific examples of such materials for the elastic layer include: various thermoplastic elastomers such as polystyrene-based, polyolefin-based, polyurethane-based, polyester-based, polyvinyl chloride-based, polybutadiene-based and polyamide-based thermoplastic elastomers, and various cured rubbers such as natural rubber, silicone rubber, cis-polyisoprene rubber, styrene-butadiene rubber, cis-polybutadiene rubber, chloroprene rubber, butyl rubber, nitrile rubber, ethylene-propylene rubber, acrylic rubber and urethane rubber. Among these, silicone rubber is more preferably used from the viewpoints of uniformity in reacting property and superior compression set.

The above-mentioned silicone rubber is formed by appropriately curing organopolysiloxane represented by the following general formula (I):

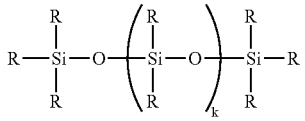

(I)

In formula (I), R each independently represents a hydrogen atom, an alkyl group, an aryl group, a vinyl group or an allyl group. With respect to the alkyl group, those having 1 to 4 carbon atoms, in particular, having one carbon atom, are preferably used; and examples thereof include a methyl group, an ethyl group, an n-propyl group and an isopropyl group. With respect to the aryl group, those having 6 to 10 carbon atoms, in particular, having 6 carbon atoms, are preferably used; and examples thereof include a phenyl group and a naphthyl group.

With respect to k, not particularly limited as long as the objective of the present invention is achieved, it is preferably determined so that the molecular weight is normally set in a range from 100,000 to 1,000,000.

Organopolysiloxane as described above is available as a commercial product, for example, made by Dow Corning Toray Silicone Co., Ltd.

Specific examples for the curing agent for curing organopolysiloxane include benzoyl peroxide and polyorganohydrogen siloxane.

With respect to the degree of curing of silicone rubber, not particularly limited as long as the objective of the present invention is achieved, it is preferably set in a range so as to allow the elastic layer to have the above-mentioned hardness.

In order to impart conductivity to the elastic layer, a conductive substance, such as a conductive filler, which is formed by coating a core material, such as conductive carbon black, metal powder like aluminum, nickel and copper, and titanium oxide, with tin oxide, may be blended therein.

The elastic layer may be formed on the conductive core member serving as the substrate by using any one of molding methods, such as extrusion-molding, injection-molding and casting methods. After the molding process, the layer is cured so that elasticity is applied thereto. After molding the elastic layer, the surface is preferably polished by using various polishing processes in order to improve the dimensional precision (outer diameter, deflection) and the uniformity of the surface (surface roughness).

Although not particularly limited, the average thickness of the elastic layer is, for example, set in a range from 0.3 to 3.0 mm, preferably from 0.5 to 2.0 mm.

The primer layer 3, which improves the adhesive strength between the surface-coating layer that will be described later and the elastic layer, and prevents separation of the surface-coating layer, is formed of at least a silane coupling agent and a conductive substance. In the present invention, by allowing the primer layer to contain the conductive substance, it becomes possible to stabilize the amount of toner transport to the developing area between the developing roller and the photosensitive member, and consequently to prevent toner spillage. Although this mechanism has not been clarified, it is considered that the mechanism is exerted based upon the following mechanism. In other words, when no conductive substance is contained in the primer layer, the electric resistance of the layer becomes higher, the mobility of charge tends to deviate due to coating irregularities and the like. When the mobility of charge in the developing roller deviates, significant fluctuations in the amount of toner transport tend to occur due to an environmental change, resulting in toner spillage particularly in a low temperature-low humidity environment. In the present invention, since the primer layer is allowed to contain a conductive substance, the electric resistance in the layer is lowered, deviations in the mobility of charge are effectively reduced even when there are coating irregularities and the like. Thus, it can be thought that even when the developing roller is used under any environment for a long time, the amount of toner transport is stabilized, and consequently, it becomes possible to effectively prevent toner spillage even when it is used under any environment, in particular, even under a low temperature-low humidity environment.

In the present invention, the silane coupling agent, which is an organic silicon compound having a functional group capable of reacting with an elastic layer constituent material and a functional group capable of reacting with a surface-coating layer constituent material, includes, for example, a so-called isocyanate-based, amino-based, mercapto-based, vinyl-based, epoxy-based, styryl-based, methacryloxy-based, acryloxy-based, ureido-based, chloropropyl-based and sulfide-based silane-coupling agent for use.

The silane coupling agent is selected depending on the elastic layer constituent material and the surface-coating layer constituent material. For example, in the case when the elastic layer constituent material is silicone rubber and the surface-coating layer causes a urethane reaction, an isocyanate-based silane coupling agent, an epoxy-based silane coupling agent and an amino-based silane coupling agent may be used. In the case when the surface-coating layer causes an addition reaction of a vinyl group, a vinyl-based silane coupling agent may be used.

With respect to the isocyanate-based silane coupling agent, for example, a commercial product, KBE-9007, and KBP-44 diluted in a solvent (made by Shin-Etsu Chemical Co., Ltd.), may be used.

Examples of the amino-based silane coupling agent include commercial products, such as KBP-40, KBP-41, KBP-43, KBP-90, KBM-602, KBM-603, KBE-603, KBM-903, KBE-903, KBE-9103, KBM-573, KBM-575 and KBM-6123 (made by Shin-Etsu Chemical Co., Ltd.), and SH6020, AY43-059 and SZ6023 (made by Dow Corning Toray Silicone Co., Ltd.).

Examples of the mercapto-based silane coupling agent include commercial products, such as X-12-414, KBM-802 and KBM-803 (made by Shin-Etsu Chemical Co., Ltd.), and SZ6062 and Z-6911 (made by Dow Corning Toray Silicone Co., Ltd.).

Examples of the vinyl-based silane coupling agent include commercial products, such as KA-1003, KBM-1003 and KBE-1003 (made by Shin-Etsu Chemical Co., Ltd.), and SZ6075 (made by Dow Corning Toray Silicone Co., Ltd.).

Examples of the epoxy-based silane coupling agent include commercial products, such as KBM-303, KBM-403, KBE-402 and KBE-403 (made by Shin-Etsu Chemical Co., Ltd.), and SH6040 and AY43-026 (made by Dow Corning Toray Silicone Co., Ltd.).

Examples of the styryl-based silane coupling agent include commercial products, such as KBM-1403 (made by Shin-Etsu Chemical Co., Ltd.).

Examples of the methacryloxy-based silane coupling agent include commercial products, such as KBM-502, KBM-503, KBE-502 and KBE-503 (made by Shin-Etsu Chemical Co., Ltd.).

Examples of the acryloxy-based silane coupling agent include commercial products such as KBM-5103 (made by Shin-Etsu Chemical Co., Ltd.).

Examples of the ureido-based silane coupling agent include commercial products such as KBE-585 (made by Shin-Etsu Chemical Co., Ltd.) and AY43-31 (made by Dow Corning Toray Silicone Co., Ltd.).

Examples of the chloropropyl-based silane coupling agent include commercial products such as KBM-703 (made by Shin-Etsu Chemical Co., Ltd.).

Examples of the sulfide-based silane coupling agent include commercial products such as KBE-846 (made by Shin-Etsu Chemical Co., Ltd.), and Z-6920 and Z-6940 (made by Dow Corning Toray Silicone Co., Ltd.).

With respect to the conductive substance, not particularly limited as long as it can impart conductivity to the primer layer when contained therein, examples thereof include carbon black, metal particles and ion conductive substances.

Specific examples of carbon black include: Ketchen Black, furnace black and acetylene black.

Specific examples of metal particles include: aluminum particles, an iron powder, a copper powder and a silver powder.

Specific examples of the ion conductive substance include salicylic acid metal complexes. With respect to the salicylic acid metal complexes, for example, an aluminum salicylate complex, a chromium salicylate complex, an iron salicylate complex and a zinc salicylate complex may be used.

The average particle size of carbon black and metal particles is preferably set in a range from 0.1 to 4 μm.

Any one of the conductive materials may be used alone, or two or more of these may be used in combination.

Among the above-mentioned conductive substances, ion conductive substances are preferably used. The ion conductive property refers to a property in which, in an electrolytic solution with the substance being dissociated into positive and negative ions, an electric current is allowed to flow through movements of the dissociated ionic substances under a certain electric field. By using substances having such an ion conductive property, it becomes possible to more effectively reduce deviations in the charge transporting property in the primer layer. Consequently, the amount of toner transport is further stabilized, and toner spillage is more effectively prevented.

Among the above-mentioned ion conductive substances, those which exert solubility to the silane coupling agent, that is, for example, salicylic acid metal complexes, in particular, aluminum salicylate complexes, are most preferably used. Since those substances exert solubility to the silane coupling agent while exerting ion conductivity, they are uniformly dispersed in the primer layer on a molecular basis. Thus, it becomes possible to most effectively reduce deviations in the charge transporting property in the primer layer. Consequently, the amount of toner transport is stabilized most effectively and the toner spillage can be also prevented most effectively.

The term, "exerting solubility to the silane coupling agent", refers to the fact that when the conductive substance is added to and mixed with the silane coupling agent at normal temperature, at the amount which will be described later, the resulting mixed solution becomes visually transparent within one minute.

Although not particularly limited as long as the primer layer is allowed to achieve the above-mentioned volume resistivity, the content of the conductive substance is normally set in a range from 0.5 to 10 parts by weight, preferably from 1 to 8 parts by weight, more preferably from 4 to 7 parts by weight, with respect to 100 parts by weight of the silane coupling agent.

The primer layer can be formed through processes in which a primer solution, prepared by dissolving or dispersing a silane coupling agent and a conductive substance in a solvent, is applied and then dried. Not particularly limited as long as it dissolves the silane coupling agent, examples of the solvent include alcohols, such as methanol, ethanol and isopropyl alcohol, and organic solvents, such as toluene, xylene, ethyl acetate and methylethyl ketone (MEK).

The application amount of the primer solution, which is preferably adjusted so that the average thickness of the primer layer is set in a range from 0.1 to 5 μm, preferably from 1 to 3 μm, is normally set in a range from 0.02 to 1.0 $mg/cm^2$, preferably from 0.2 to 0.6 $mg/cm^2$.

The average thickness of the primer layer can be measured by cutting the roller and enlarging the cross section by using a microscope or the like.

With respect to the coating method for the primer solution, not particularly limited, for example, methods, such as a spray coating method, a roll coater method and a brush coating method, may be used.

With respect to the drying method, methods, such as an air-drying method in which the layer is naturally dried, a drying method in which air is forcefully applied to the layer and a heat drying method, may be used.

The surface-coating layer 4 is formed by a material that frictionally charges toner, serves as a transport dielectric layer to the photosensitive layer and is superior in charging property and releasing property with respect to toner. Specific constituent materials include: urethane resins (including urethane resins containing a fluorine-containing compound), silicone resins and fluorine resins, and any one of these may be used alone, or two or more of these may be used in combination.

The surface-coating layer preferably has a volume resistivity in a range from $10^7$ to $10^{10}$ Ω·cm and JIS-A hardness in a range from 50° to 80°.

In order to achieve the above-mentioned volume resistivity, the surface-coating layer preferably contains a conductive substance.

The conductive substance contained in the surface-coating layer is exemplified by carbon black, metal powder and the like. A preferable conductive substance is carbon black.

With respect to the surface-coating layer, the surface roughness may be controlled by applying a volatile solvent (holes resulting from the volatile process are utilized) or roughness-applying particles such as resin particles and inorganic fine particles thereto.

With respect to the volatile solvent, those solvents that are completely volatilized before a polyurethane reaction in the surface-coating layer has been completed. Examples thereof include low-boiling-point organic solvents that do not react with the coating material or hardly react therewith. For example, dimethyl silicone oil, cyclic silicone oil and the like may be used.

Examples of the resin particles include acrylic resin particles and silicone resin particles. Examples of the inorganic particles include silica fine particles and metal oxide particles such as titania particles.

The surface-coating layer can be formed through processes in which a coating solution, prepared by mixing and dispersing a coating-layer constituent material, various additives such as a roughness-adjusting agent and a solvent or the like, is applied and dried.

In the case when the surface-coating layer comprises urethane resin, the material is constituted by a polyol component and an isocyanate component, and in particular, a fluorine-containing polyol is preferably used as the polyol component. For example, polyols, such as a copolymer polyol mainly composed of a trifluoride ethylene monomer and a copolymer polyol mainly composed of tetrafluoride ethylene monomer, may be used. With respect to the isocyanate component, diisocyanates, such as diphenyl methane diisocyanates (MD) and tolylene diisocyanates (TDI), urethane-modified diisocyanates and alcohol-modified diisocyanates may be preferably used.

Examples of fluorine-containing polyols include: Zeffle (made by Daikin Industries, Ltd.), Lumiflon (made by Asahi Glass Co., Ltd.) and Defensa (made by Dainippon Ink & Chemicals, Inc.). Examples of urethane-modified diisocyanates include: Duranate (made by Asahi Kasei Corporation, and examples of alcohol-modified diisocyanates include: Cosmonate (made by Mitsui Takeda Chemicals, Inc.).

With respect to the solvent, not particularly limited as long as it can dissolve the above-mentioned materials and does not intervene with the formation of the surface-coating layer material, examples thereof include butyl acetate, ethyl acetate, xylene and toluene.

With respect to the coating method of the surface-coating solution, not particularly limited methods, such as a spray coating method, a roll coater method and a brush coating method, may be used.

With respect to the drying method, methods, such as an air-drying method in which the layer is naturally dried, a drying method in which air is forcefully applied to the layer and a heat drying method, may be used.

The average thickness of the surface-coating layer is normally set in a range from 3 to 100 μm, preferably from 5 to 30 μm.

The average thickness of the surface-coating layer can be measured by using the same method as the primer layer.

The developing roller of the present invention is preferably provided with an adhesive layer (not shown) between the substrate 1 and the elastic layer 2 on demand.

The adhesive layer, which is formed so as to prevent separation between the substrate and the elastic layer, is formed from, for example, a thermoplastic resin (low-molecular-weight polyolefin or the like), any one of various coupling agents or the like.

With respect to the coating method for the adhesive layer, depending on materials, the corresponding material is heated or dissolved in a solvent so that the resulting solution is coated. For example, methods, such as a spray coating method, a roll coater method, and a brush coating method, may be used.

Not particularly limited, the average thickness of the adhesive layer is preferably set, for example, in a range from 0.1 to 10 μm.

The average thickness of the adhesive layer can be measured by using the same method as the primer layer.

After the primer layer and the surface-coating layer have been superposed and applied onto the outside of the elastic layer, these are heated by an electric furnace or the like so as to accelerate the polymerizing reaction between the primer layer and the coating layer and evaporate the solvent. The heating temperature is changed depending on the material of the coating layer and the solvent. For example, the temperature is set in a range from 120° to 180° C., and the heating time is set in a range of around 30 minutes to 2 hours. When the polymerizing reaction does not progress sufficiently or when the evaporation of the solvent does not take place sufficiently, the film strength of the surface-coating layer becomes insufficient, causing toner fusion and separation of the coating layer.

Figure 2:
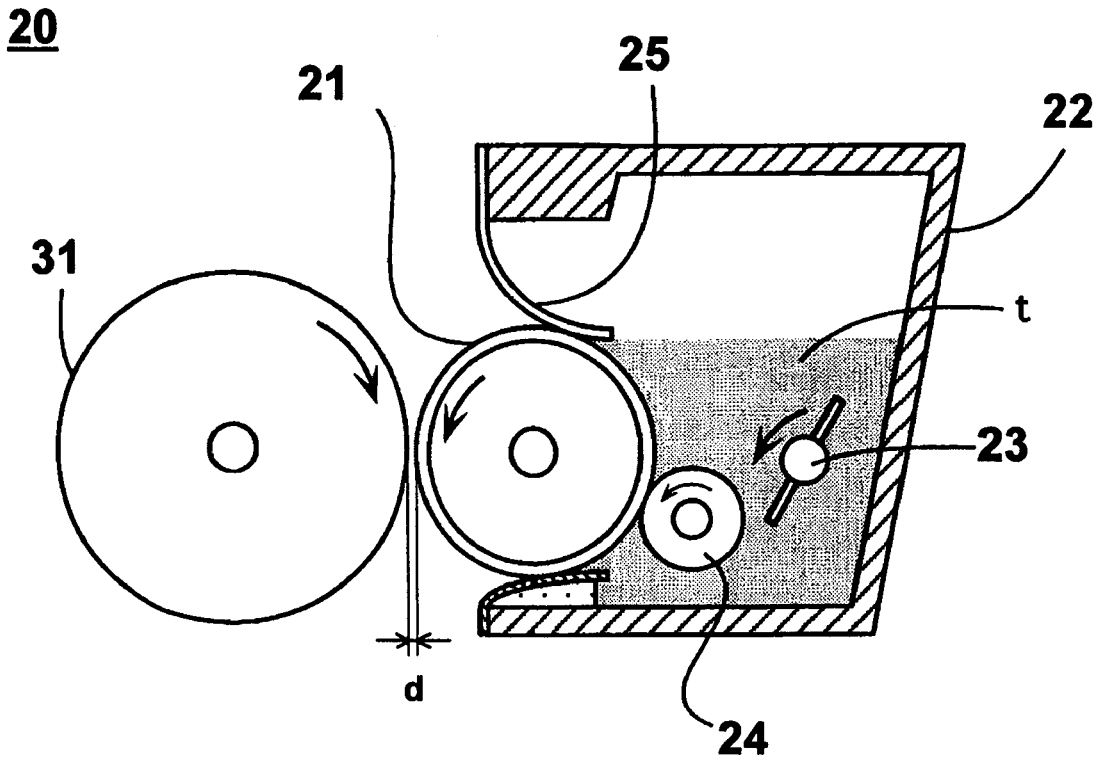
FIG. 2 is a schematic block diagram of a developing device equipped with a developing roller of the present invention.

The developing roller of the present invention is effectively applied to a developing device of a mono-component developing system. An example of the mono-component developing device is shown in FIG. 2. In the developing device 20 shown in FIG. 2, the developing roller 21 is located oppositely to an image-supporting member 31 with a specified space d between the two in a developing area. While the developing roller 21 and the image-supporting member 31 are rotated, toner t housed in a casing 22 is fed to a supply roller 24 by a feeding member 23. The toner t is supplied to the surface of developing roller 11 from the supply roller 24.

A regulating member 25 in contact with the surface of developing roller 21 regulates an amount of toner t supplied on the surface of developing roller 21 and charges the toner t electrically. The toner t is transported to a developing area opposite to the image-supporting member 31. A voltage is applied between the developing roller 21 and the image-supporting member 31, so that toner t is supplied to electrostatic latent images formed on the image-supporting member for development.

In combination with the developing roller of the present invention, any of generally-used toners may be used (without being influenced by ground toner, polymerized toner and the toner shape, particle size and the material of the toner), and the developing roller may be applied to both of the contact developing system and the non-contact developing system.

EXAMPLES

Example 1

(Preparation of Primer Solution>

To 100 parts by weight of a silane coupling agent (KBP-44; made by Shin-Etsu Chemical Co., Ltd.) was added 1 part by weight of Ketchen Black (made by Lion Corporation) as an additive, and this was further diluted by adding 300 parts by weight of isopropyl alcohol thereto so that a primer solution was prepared.

(Preparation of Surface-Coating Solution)

To 100 parts by weight of fluorine-containing polyol (Zeffle, made by Daikin Industries, Ltd. and 8 parts by weight of conductive carbon black (made by Cabot Corporation) was added 300 parts by weight of butyl acetate, and dispersed by using a disperser. To this dispersion solution was added 50 parts by weight of reactive silicone oil with two carbinol-modified terminals (X-22-16-AS; made by Shin-Etsu Chemical Co., Ltd.) and stirred to prepare a main coating agent. To this main agent was added urethane-modified hexamethylene diisocyanate (Duranate, made by Asahi Kasei Corporation) serving as a curing agent so that equivalent of the hydroxyl group in the main agent and equivalent of the isocyanate group in the curing agent may become 1:1; thus, a surface-coating solution was prepared.

(Production of Developing Roller)

A core metal shaft, which was made of iron and had an outer diameter of 16 mm, was coated with conductive silicone rubber having a volume resistivity of $10^3$ Ω·cm and JIS-A hardness of 45°, and polished to form a silicone rubber-coated roller having an outer diameter of 18 mm.

The above-mentioned rubber-coated roller was spray-coated with the primer solution so as to be set at 0.5 mg/cm$^2$, and air-dried. Thereafter, this was then spray-coated with the surface-coating solution so that the thickness of the surface-coating layer after the urethane reaction became 12 μm, and after having been air-dried, this was heated at 140° C. for 60 minutes to prepare a developing roller.

Example 2

The same processes as example 1 were carried out except that the following primer solution was used to prepare a developing roller.

(Preparation of Primer Solution)

To 100 parts by weight of a silane coupling agent (KBP-44; made by Shin-Etsu Chemical Co., Ltd.) was added 5 parts by weight of Ketchen Black (made by Lion Corporation) as an additive, and this was further diluted by adding 300 parts by weight of isopropyl alcohol thereto so that a primer solution was prepared.

Example 3

The same processes as example 1 were carried out except that the following primer solution was used to prepare a developing roller.

(Preparation of Primer Solution)

To 100 parts by weight of a silane coupling agent (KBP-44; made by Shin-Etsu Chemical Co., Ltd.) was added 1 part by weight of furnace black (made by Cabot Corporation) as an additive, and this was further diluted by adding 300 parts by weight of isopropyl alcohol thereto so that a primer solution was prepared.

Example 4

The same processes as example 1 were carried out except that the following primer solution was used to prepare a developing roller.

(Preparation of Primer Solution)

To 100 parts by weight of a silane coupling agent (KBP-44; made by Shin-Etsu Chemical Co., Ltd.) was added 5 parts by weight of furnace black (made by Cabot Corporation) as an additive, and this was further diluted by adding 300 parts by weight of isopropyl alcohol thereto so that a primer solution was prepared.

Example 5

The same processes as example 1 were carried out except that the following primer solution was used to prepare a developing roller.

(Preparation of Primer Solution)

To 100 parts by weight of a silane coupling agent (KBP-44; made by Shin-Etsu Chemical Co., Ltd.) was added 1 part by weight of aluminum powder (made by TOYO ALUMINIUM K.K.; average particle size: 3 μm) as an additive, and this was further diluted by adding 300 parts by weight of isopropyl alcohol thereto so that a primer solution was prepared.

Example 6

The same processes as example 1 were carried out except that the following primer solution was used to prepare a developing roller.

(Preparation of Primer Solution)

To 100 parts by weight of a silane coupling agent (KBP-44; made by Shin-Etsu Chemical Co., Ltd.) was added 1 part by weight of aluminum salicylate complex (made by Orient Chemical Industries, Ltd.) as an additive, and this was further diluted by adding 300 parts by weight of isopropyl alcohol thereto so that a primer solution was prepared.

Example 7

The same processes as example 1 were carried out except that the following primer solution was used to prepare a developing roller.

(Preparation of Primer Solution)

To 100 parts by weight of a silane coupling agent (KBP-44; made by Shin-Etsu Chemical Co., Ltd.) was added 5 parts by weight of aluminum salicylate complex (made by Orient Chemical Industries, Ltd.) as an additive, and this was further diluted by adding 300 parts by weight of isopropyl alcohol thereto so that a primer solution was prepared.

Example 8

The same processes as example 1 were carried out except that the following primer solution was used to prepare a developing roller.

(Preparation of Primer Solution)

To 100 parts by weight of a silane coupling agent (KBP-44; made by Shin-Etsu Chemical Co., Ltd.) was added 8 parts by weight of aluminum salicylate complex (made by Orient Chemical Industries, Ltd.) as an additive, and this was further diluted by adding 300 parts by weight of isopropyl alcohol thereto so that a primer solution was prepared.

Example 9

The same processes as example 1 were carried out except that the following primer solution was used to prepare a developing roller.

(Preparation of Primer Solution)

To 100 parts by weight of a silane coupling agent (KBP-44; made by Shin-Etsu Chemical Co., Ltd.) was added 1 part by weight of chromium salicylate complex (made by Orient Chemical Industries, Ltd.) as an additive, and this was further diluted by adding 300 parts by weight of isopropyl alcohol thereto so that a primer solution was prepared.

Example 10

The same processes as example 1 were carried out except that the following primer solution was used to prepare a developing roller.

(Preparation of Primer Solution)

To 100 parts by weight of a silane coupling agent (KBP-44; made by Shin-Etsu Chemical Co., Ltd.) was added 5 parts by weight of chromium salicylate complex (made by Orient Chemical Industries, Ltd.) as an additive, and this was further diluted by adding 300 parts by weight of isopropyl alcohol thereto so that a primer solution was prepared.

Comparative Example 1

The same processes as example 1 were carried out except that the following primer solution was used to prepare a developing roller.

(Preparation of Primer Solution)

To 100 parts by weight of a silane coupling agent (KBP-44; made by Shin-Etsu Chemical Co., Ltd.) was added 300 parts by weight of isopropyl alcohol so as to be diluted; thus, a primer solution was prepared.

Comparative Example 2

The same processes as example 1 were carried out except that the following primer solution was used to prepare a developing roller.

(Preparation of Primer Solution)

To 100 parts by weight of a silane coupling agent (KBP-44; made by Shin-Etsu Chemical Co., Ltd.) was added 5 parts by weight of acrylic resin particles (average particle size: 3 μm) as an additive, and this was further diluted by adding 300 parts by weight of isopropyl alcohol thereto so that a primer solution was prepared.

Comparative Example 3

The same processes as example 1 were carried out except that the following primer solution was used to prepare a developing roller.

(Preparation of Primer Solution)

To 100 parts by weight of a silane coupling agent (KBP-44; made by Shin-Etsu Chemical Co., Ltd.) was added 5 parts by weight of silica fine particles (average particle size: 0.2 μm) as an additive, and this was further diluted by adding 300 parts by weight of isopropyl alcohol thereto so that a primer solution was prepared.

<Evaluation>

(Toner Transporting Property)

Each of the developing rollers was incorporated into a color laser beam printer made by Konica Minolta Business Technologies, Inc. (magicolor 7300), and endurance printing tests of 500 sheets and 10,000 sheets were carried out under the NN environment (temperature 23±3° C., humidity 65±5%), and the amount of transported toner on the developing roller after the endurance tests was measured. More specifically, the amount of toner transport (M/S) was obtained by suction-collecting toner supported on the developing roller in the middle of a solid-white image developing process, and based upon the toner weight M at that time and a suction area S on the developing roller, the amount of toner transport M/S ($g/m^2$) per unit area on the developing roller was calculated. When the amount of transport is too small, the image density is lowered and image blurring tends to occur. In contrast, when the amount of transport is too great, fogging tends to occur. The evaluation was also carried out under the HH environment (temperature 35±3° C., humidity 85±5%) as well as under the LL environment (temperature 10±2° C., humidity 15±5%)

The evaluation criteria is explained as follows: Each of the amounts of toner transport after the endurance printing process of 500 sheets as well as after the endurance printing process of 10,000 sheets was evaluated based upon the following criteria, and the results of the worse case were shown.

⊙: from not less 6 $g/m^2$ to less than 7 $g/m^2$;

○: from not less 5 $g/m^2$ to less than 6 $g/m^2$, or from not less 7 $g/m^2$ to less than 8 $g/m^2$;

Δ: from not less 4 $g/m^2$ to less than 5 $g/m^2$, or from not less than 8 $g/m^2$ to less than 10 $g/m^2$;

x: less than 4 $g/m^2$, or not less than 10 $g/m^2$.

(Toner Spillage)

Each of the developing rollers was incorporated into a color laser beam printer made by Konica Minolta Business Technologies, Inc. (magicolor 7300), and endurance printing test of 5,000 sheets was carried out under the LL environment (temperature 10±2° C., humidity 15±5%) at a printing rate of 5%, and the frequency of occurrences of toner spillage on paper was measured. When no toner spillage occurred, this case was evaluated as "OK", and when toner spillage occurred even on a single sheet, such a case was evaluated as "NG". The evaluation was also carried out under the NN environment as well as under the HH environment.

The results are shown in the following Table.

TABLE 1

| | Conductive substance | Amount of addition ** | Primer amount of coat | Toner transporting property | | | Spillage | | |
|---|---|---|---|---|---|---|---|---|---|
| | | | | LL | NN | HH | LL | NN | HH |
| Example 1 | Ketchen Black | 1% | 0.5 $mg/cm^2$ | Δ | ○ | Δ | OK | OK | OK |
| Example 2 | Ketchen Black | 5% | 0.5 $mg/cm^2$ | ○ | ○ | Δ | OK | OK | OK |
| Example 3 | Furnace black | 1% | 0.5 $mg/cm^2$ | Δ | ○ | Δ | OK | OK | OK |
| Example 4 | Furnace black | 5% | 0.5 $mg/cm^2$ | Δ | ○ | Δ | OK | OK | OK |
| Example 5 | Metal powder (aluminum) | 1% | 0.5 $mg/cm^2$ | ○ | ○ | Δ | OK | OK | OK |
| Example 6 | Aluminum salicylate complex | 1% | 0.5 $mg/cm^2$ | ○ | ⊙ | ⊙ | OK | OK | OK |
| Example 7 | Aluminum salicylate complex | 5% | 0.5 $mg/cm^2$ | ⊙ | ⊙ | ⊙ | OK | OK | OK |
| Example 8 | Aluminum salicylate complex | 8% | 0.5 $mg/cm^2$ | ⊙ | ⊙ | ⊙ | OK | OK | OK |
| Example 9 | Chromium salicylate complex | 1% | 0.5 $mg/cm^2$ | ○ | ⊙ | ○ | OK | OK | OK |
| Example 10 | Chromium salicylate complex | 5% | 0.5 $mg/cm^2$ | ⊙ | ⊙ | ○ | OK | OK | OK |
| Comparative Example 1 | No | 0% | 0.5 $mg/cm^2$ | X | ○ | Δ | NG | OK | OK |
| Comparative Example 2 | Resin particles * | 5% | 0.5 $mg/cm^2$ | X | Δ | Δ | NG | OK | OK |
| Comparative Example 3 | Silica particles * | 5% | 0.5 $mg/cm^2$ | X | ○ | Δ | NG | OK | OK |

* Non-conductive

** Amount of addition is indicated by a weight rate to a primer material (silane coupling agent).

What is claimed is:

1. A developing roller for use in an image-forming apparatus, comprising:

a substrate;

an elastic layer formed on the substrate;

a primer layer formed on the elastic layer; and a surface-coating layer formed at the outermost surface, wherein the primer layer comprises an ion conductive substance and the ion conductive substance is a salicylic acid metal complex.

2. The developing roller according to claim 1, wherein the salicylic acid metal complex is an aluminum salicylate complex andlor a chromium salicylate complex.

3. A developing roller for use in an image-forming apparatus, comprising:

a substrate;

an elastic layer formed on the substrate a primer layer formed on the elastic layer; and a surface-coating layer formed at the outermost surface, wherein the primer layer comprises a conductive substance and a silane coupling agent, and the content of the conductive substance is in a range from 0.5 to 10 parts by weight with respect to 100 parts by weight of the silane coupling agent.

4. A developing device, comprising:

a casing;

a toner housed in the casing; and a developing roller which supports toner on the surface and transports the toner, wherein the developing roller comprises:

a substrate;

an elastic layer formed on the substrate;

a primer layer formed on the elastic layer; and a surface-coating layer formed at the outermost surface, wherein the primer layer comprises an ion conductive substance, and the ion conductive substance is a salicylic acid metal complex.

5. The developing device according to claim 4, wherein the salicylic acid metal complex is an aluminum salicylate complex and/or a chromium salicylate complex.

6. A developing device comprising:

a casing;

a toner housed in the casing; and a developing roller which supports toner on the surface and transports the toner, wherein the developing roller comprises:

a substrate;

an elastic layer formed on the substrate;

a primer layer formed on the elastic layer; and a surface-coating layer formed at the outermost surface, wherein the primer layer comprises a conductive substance and a silane coupling agent, wherein a content of the conductive substance is in a range from 0.5 to 10 parts by weight with respect to 100 parts by weight of the silane coupling agent.

* * * * *